US006956480B2

(12) United States Patent
Jespersen

(10) Patent No.: US 6,956,480 B2
(45) Date of Patent: Oct. 18, 2005

(54) ELECTRONIC APPARATUS INCLUDING A DEVICE FOR PREVENTING LOSS OR THEFT

(75) Inventor: Hans Jacob Jespersen, Copenhagen (DK)

(73) Assignee: Nokia Mobile Phones Limited, Espoo (FI)

( * ) Notice: Subject to any disclaimer, the term of this patent is extended or adjusted under 35 U.S.C. 154(b) by 6 days.

(21) Appl. No.: 10/368,364

(22) Filed: Feb. 20, 2003

(65) Prior Publication Data

US 2003/0122671 A1 Jul. 3, 2003

Related U.S. Application Data

(63) Continuation of application No. 09/880,818, filed on Jun. 15, 2001, now Pat. No. 6,577,239.

(30) Foreign Application Priority Data

Jun. 16, 2000 (GB) ..... 0014850

(51) Int. Cl.[7] ..... G08B 13/14

(52) U.S. Cl. ..... 340/568.1; 340/568.7; 340/572.1; 340/572.8; 340/539.1; 340/539.19; 340/539.21; 340/539.23; 455/574; 455/575; 455/462

(58) Field of Search ..... 340/568.1, 568.7, 340/572.1, 572.8, 539.1, 539.19, 539.21, 539.23, 572.4, 573.1, 573.4; 455/574, 575, 462, 88

(56) References Cited

U.S. PATENT DOCUMENTS

| | | | | | |
|---|---|---|---|---|---|
| 5,067,441 | A | | 11/1991 | Weinstein | |
| 5,298,883 | A | * | 3/1994 | Pilney et al. | 340/573.2 |
| 5,796,338 | A | | 8/1998 | Mardirossian | |
| 5,939,988 | A | * | 8/1999 | Neyhart | 340/573.4 |
| 5,963,131 | A | * | 10/1999 | D'Angelo et al. | 340/568.1 |
| 6,084,517 | A | * | 7/2000 | Rabanne et al. | 340/573.4 |
| 6,151,493 | A | | 11/2000 | Sasakura et al. | |
| 6,331,817 | B1 | * | 12/2001 | Goldberg | 340/573.1 |
| 6,493,550 | B1 | * | 12/2002 | Raith | 455/422.1 |
| 6,563,427 | B2 | * | 5/2003 | Bero et al. | 340/573.1 |

FOREIGN PATENT DOCUMENTS

| | | |
|---|---|---|
| GB | 2 318 671 | 4/1998 |
| GB | 2 318 672 | 4/1998 |
| GB | 2 318 673 | 4/1998 |
| JP | 11 088499 A | 3/1999 |
| WO | WO 9748083 | 12/1997 |

* cited by examiner

*Primary Examiner*—Hung Nguyen
(74) *Attorney, Agent, or Firm*—Antonelli, Terry, Stout and Kraus, LLP.

(57) ABSTRACT

A mobile telephone includes a control device, which comprises a receiver to receive an enabling signal and a controller to enable operation of the mobile telephone in dependence upon the enabling signal. An active badge transmits the enabling signal. If the telephone and the badge are separated and the mobile telephone is no longer able to receive the enabling signal, then the controller disables the mobile telephone.

13 Claims, 11 Drawing Sheets

D

Yes
No
P>P1
S13
1st level alarm
S14
Yes
No
P1>P>P2
S15
Examine ID
(Optional)
S17
Correct ID?
No
S18
Yes
2nd level
alarm
S16
E
END

ELECTRONIC APPARATUS INCLUDING A DEVICE FOR PREVENTING LOSS OR THEFT

CROSS REFERENCE TO RELATED APPLICATION

The application is a Continuation Application of U.S. application Ser. No. 09/880,818 filed Jun. 15, 2001.

BACKGROUND OF THE INVENTION

1. Field of the Invention

The present invention relates to a communication unit including a device for preventing loss or theft, in particular, but not exclusive to, mobile telephone handsets and portable computers.

2. Description of the Prior Art

Portable electronic apparatus are prone to being lost or stolen. Mobile telephone handsets and palmtop computers are particularly vulnerable on account of their compact size and light weight.

SUMMARY OF THE INVENTION

The present invention seeks to help prevent loss or theft of such apparatus. According to the present invention there is provided electronic apparatus including a device for preventing loss or theft, the device configured to receive and assess an enabling signal from an external source and to control operation of the electronic apparatus in dependence upon said assessment.

The electronic apparatus may be portable and may be a communications unit, such as a mobile telephone, or a data processing unit, such as a computer. The device may be configured to measure the strength of the enabling signal, to trigger a first alarm if the signal strength is below a first predetermined level and to trigger a second alarm if the signal strength is below a second predetermined level. The enabling signal may include identity information for the external source and the device may be configured to examine said identity information. The device may be configured to trigger an alarm in dependence upon said identity information or to disable operation of the electronic apparatus. The device may be configured to receive a personal identification number and to enable or maintain operation of the electronic apparatus if the personal identification number is received. The device may be configured to receive the enabling signal within a defined time slot. The device may be configured to perform a first test on information relating to the enabling signal and to report the result of said first test, which may comprise an audible, visual or vibrational alarm. The device may be configured to perform a second test on information relating to the enabling signal and to report the result of said second test, which may also comprise an audible alarm. The electronic apparatus may be configured to be disabled in response to said second test and may be configured to receive a personal identification number in response to said second test. The electronic apparatus may be configured to perform a test on said personal identification number and to enable operation of itself in dependence upon the result of said test on said personal identification number. The device may be configured to receive a personal identification number in response to said second test and to perform a test on said personal identification number. The device may be configured to enable operation of the electronic apparatus in dependence upon the result of said test on said personal identification number.

The operation of said electronic apparatus may include operation of all functions of said electronic apparatus. The device may be configured to maintain operation of the apparatus.

According to the present invention there is also provided a control device for preventing loss or theft, the device configured to receive and assess an enabling signal from an external source and to control operation of the electronic apparatus in dependence said assessment.

According to the present invention there is also provided electronic apparatus incorporating said control device.

According to the present invention there is also provided control apparatus for preventing loss or theft comprising a first control device configured to transmit an enabling signal and a second control device configured to receive and assess the enabling signal and to control operation of the electronic apparatus in dependence upon the proximity of the first control device.

The first device may comprises a radio frequency tag or a Bluetooth chip and may be incorporated in a smart card, within a badge, in an item of jewelry, in an article of clothing or in an item of personal property.

The second control device may be configured to maintain operation of the electronic apparatus.

According to the present invention there is also provided a system for preventing loss or theft of electronic apparatus, the system comprising electronic apparatus, a first control device configured to transmit an enabling signal and a second control device configured to receive and assess the enabling signal and to control operation of the electronic apparatus in dependence upon said assessment.

According to the present invention there is also provided a method of preventing loss or theft, the method comprising transmitting an enabling signal and receiving and assessing the enabling signal and controlling operation of the electronic apparatus in dependence upon the assessment.

According to the present invention there is also provided a method of preventing loss or theft, the method comprising receiving and assessing an enabling signal and to control operation of the electronic apparatus in dependence said assessment.

According to the present invention there is also provided a computer program to be loaded on data processing apparatus to control operation of electronic apparatus so as to prevent loss or theft, such that the data processing apparatus receives information relating to an enabling signal received from an external source, assesses said information and controls operation of the electronic apparatus in dependence upon said assessment.

BRIEF DESCRIPTION OF THE DRAWINGS

The invention will be explained more fully below, by way of example, in connection with preferred embodiments and with reference to the drawings in which.

DETAILED DESCRIPTION OF THE INVENTION

Figure 1:
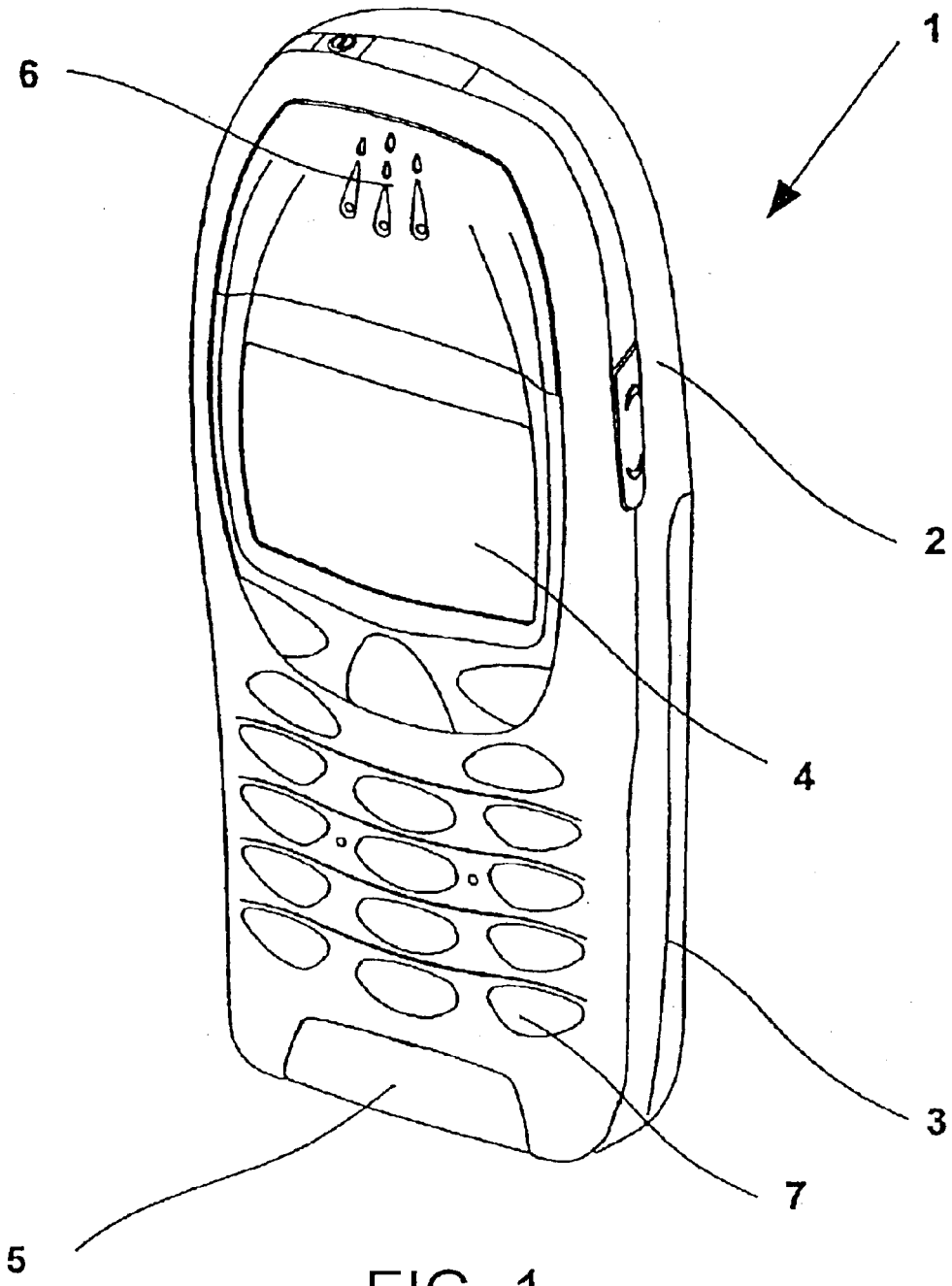
FIG. 1 is an perspective view of a prior art mobile telephone handset.
Figure 2:
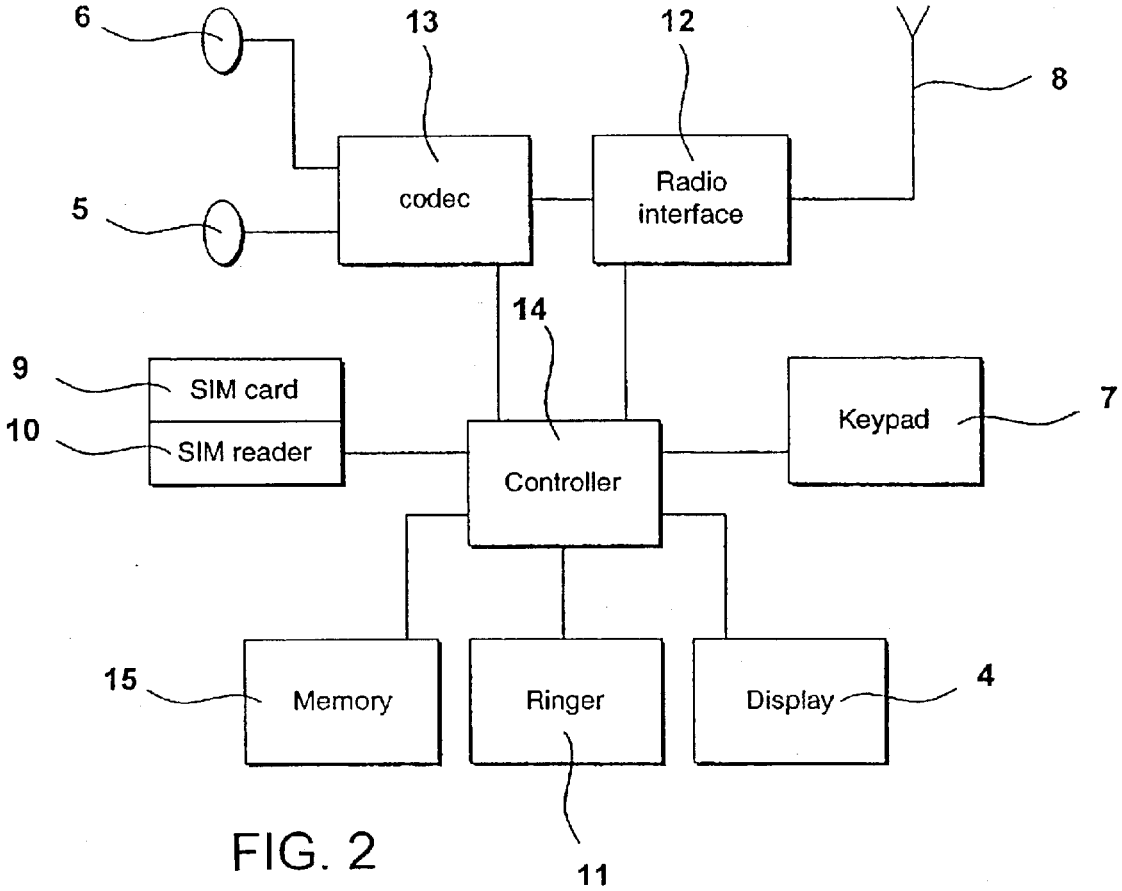
FIG. 2 is a schematic block diagram of the prior art mobile telephone circuits used with the first embodiment of the present invention.

Referring to FIGS. 1 and 2, a mobile telephone 1 comprises a case 2, a battery 3, a liquid crystal display (LCD) panel 4, microphone 5, ear-piece 6, keypad 7, antenna 8, subscriber identification module (SIM) card 9, SIM card reader 10 and a ringer 11. The mobile telephone circuitry includes radio interface circuitry 12, codec circuitry 13, controller 14 and memory 15. Individual circuits and elements are of a type well known in the art, for example in the Nokia range of mobile telephones.

Figure 4:
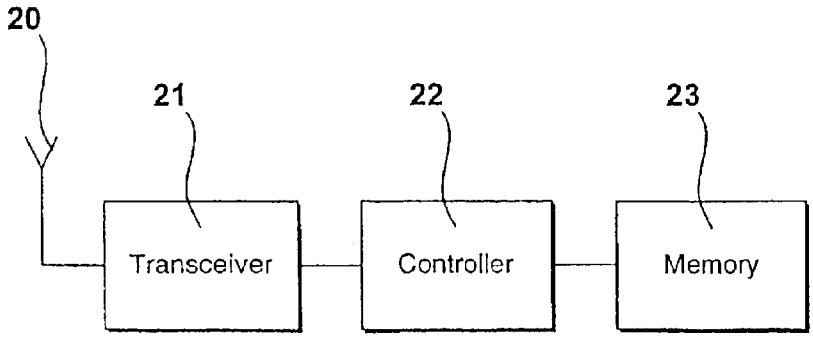
FIG. 4 is a schematic block diagram of the RF tag according to the first embodiment of the present invention.
Figure 3:
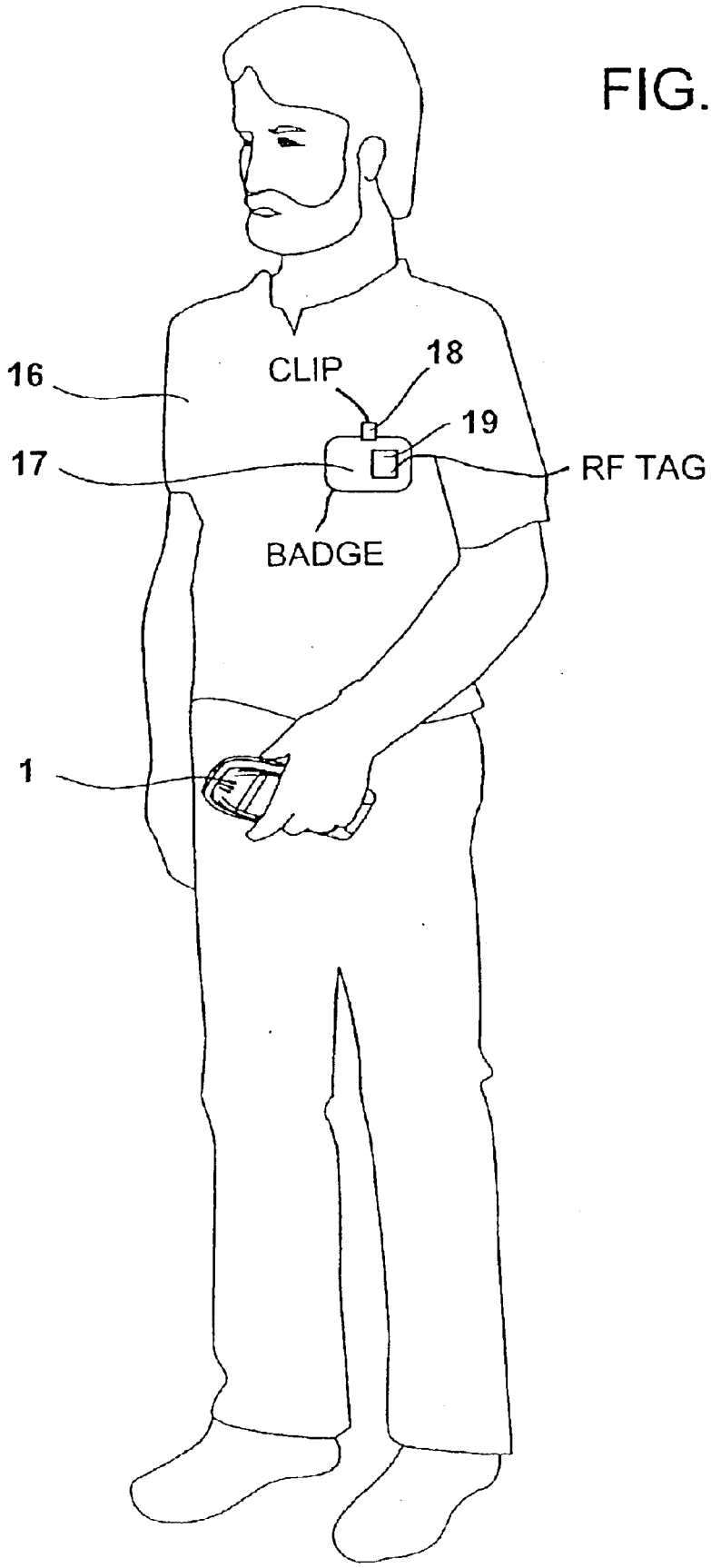
FIG. 3 shows a mobile telephone user wearing a radio frequency (RF) tag according to the first embodiment of the present invention.

Referring to FIGS. 3 and 4, a user 16 of the mobile telephone 1, wears a contactless proximity smart card badge 17 secured by a clip 18. The badge 17 comprises a radio frequency (RF) identification tag 19 of a type well known in the art. The RF tag 19 comprises a tag antenna 20, a tag transceiver 21, a tag controller 22 and tag memory 23 and is implemented on a semiconductor chip. An example of a suitable RF tag 19 is a tag manufactured according to the Mifare® Architecture Platform produced by Phillips Semiconductors with reference to International Standards Organisation (ISO) 14443A standard, parts 2 and 3.

The mobile telephone 1 and the RF tag 19 are configured to control operation of the mobile telephone 1 by the transmission and receipt of an enabling signal. The amplitude of a transmitted signal diminishes with distance. Thus, as the separation of mobile telephone 1 and the RF tag 19 increases, if the RF tag 19 transmits a signal, the received signal at the mobile telephone 1 will become weaker and vice versa. The rate of signal fall-off with distance can be rapid and significant over a distance of a few meters.

If the user 16 inadvertently forgets the mobile telephone 1 and walks away from it or a thief steals the telephone 1 and attempts to make away with it, the separation of telephone 1 and the tag 19 increases. As a result, the strength of the signal transmitted by a RF tag 19 and received by the mobile telephone 1 will fade. If the received signal strengths falls below a certain threshold or if exchange of signals breaks down, the mobile telephone 1 raises an alarm and, if necessary, disables itself.

The exchange of signals between the mobile telephone 1 and the RF tag 19 will now be described in more detail.

Figure 5A:
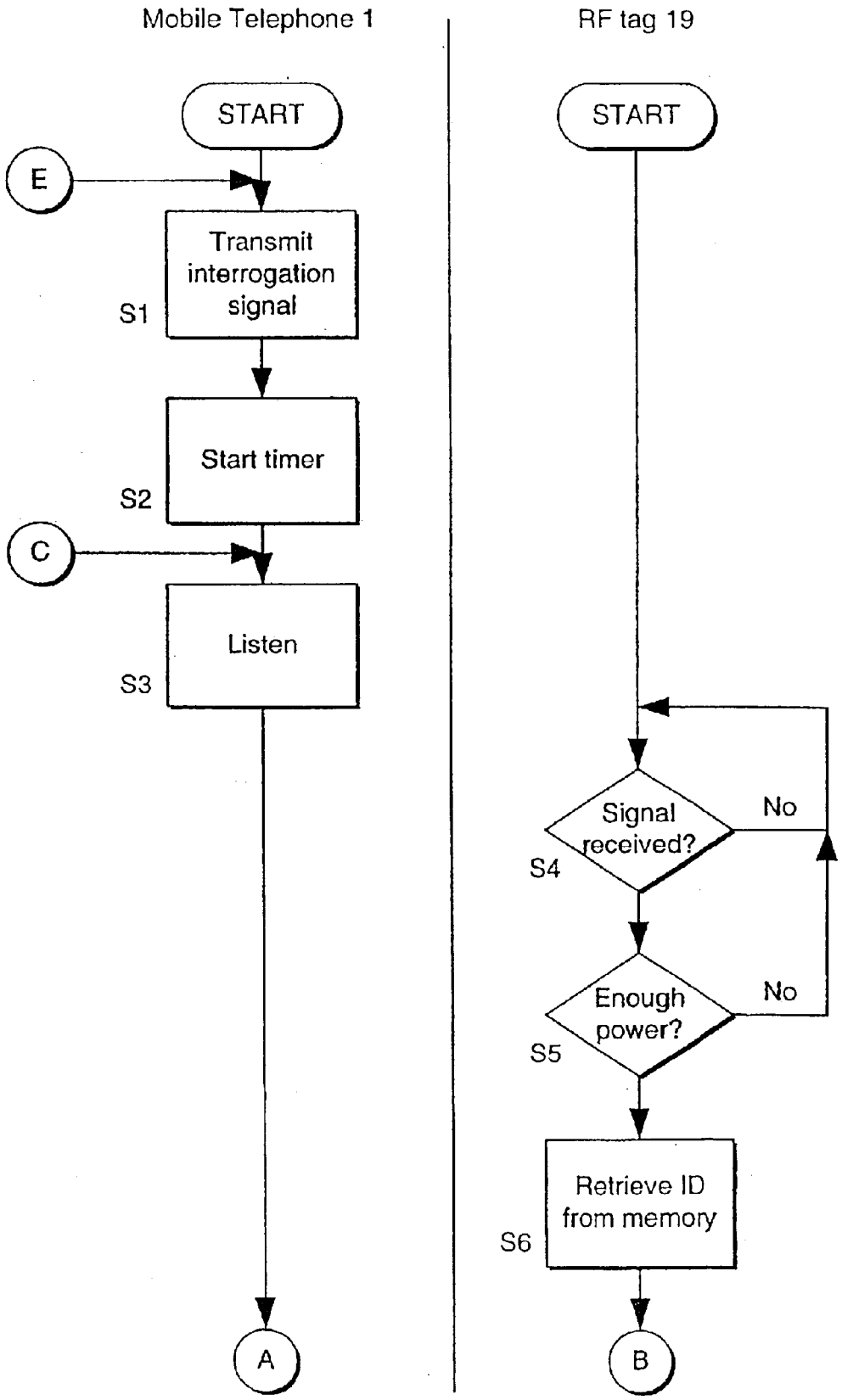
FIGS. 5*a*, 5*b* and 5*c* are parts of a process flow diagram of the interaction between the mobile telephone handset and the RF tag according to the first embodiment of the present invention.
Figure 5B:
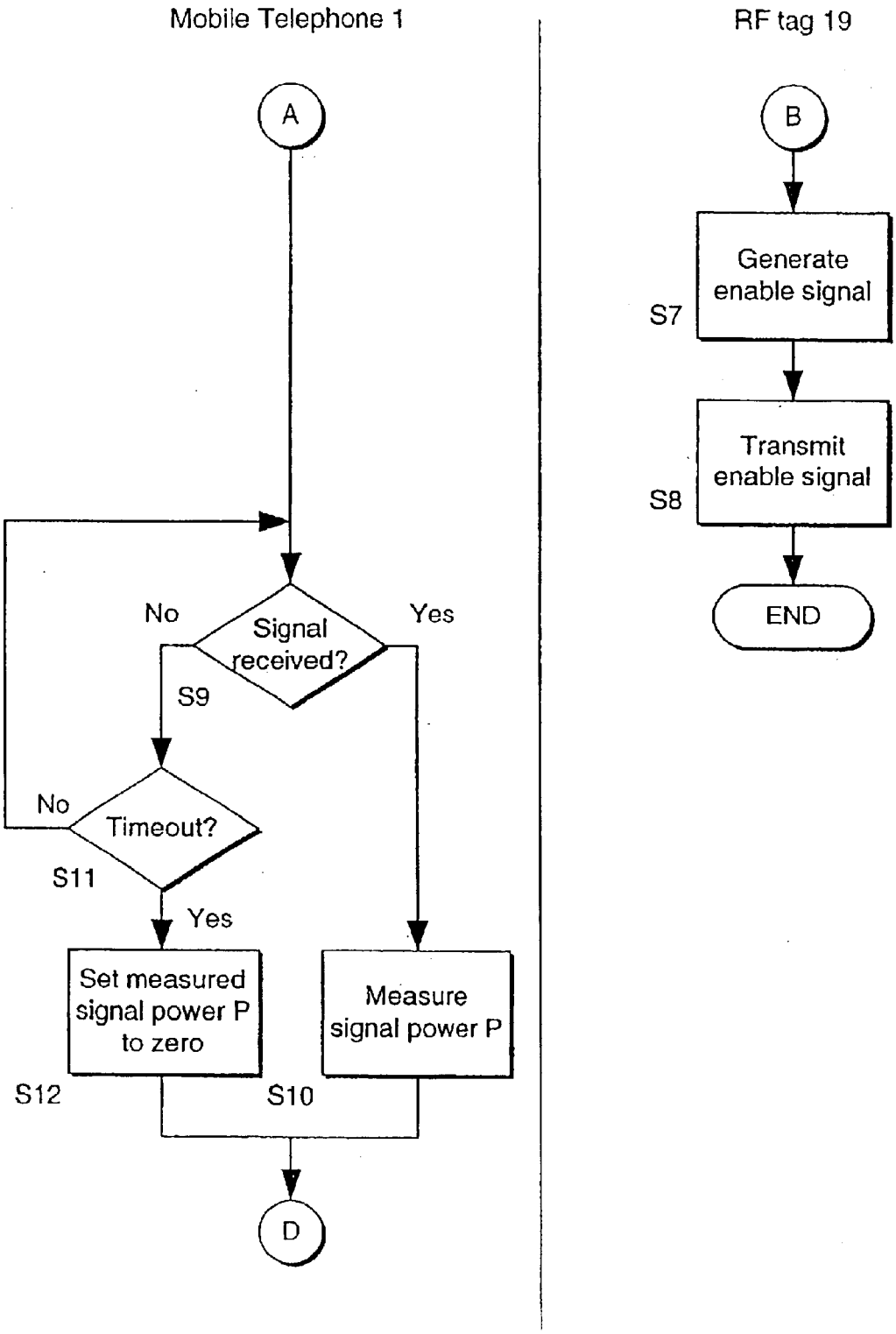

Referring to FIGS. 5*a* and 5*b*, the mobile telephone 1 transmits an interrogation signal (step S1), starts a timer (step S2) and begins listening for a reply (step S3). The signal comprises a 64-bit number RAND, randomly generated by the controller 14. In this example, the interrogation signal is transmitted at a frequency in the range of 1 to 2 GHz by the radio interface circuits 12, which are used for communication. It will be appreciated that a separate transceiver may be used instead. It will also be appreciated that other frequencies may be used, for example those specified in ISO 14443A, parts 2 and 3.

In this example, the RF tag 19 has no power source of its own. It receives power from rectification of the signal from the mobile telephone 1. Thus, the RF tag 19 is inactive until it receives a signal at a particular frequency (step S4) and if the signal is sufficiently strong then RF tag 19 is supplied with power (step S5). It will be appreciated that RF tags may be used that have their own power source, such a battery or solar cell.

Once, the RF tag 19 is powered, the tag controller 22 retrieves from tag memory 23 the RF tag's identity label ID_LABEL (step S6). In this example, the RF tag's identity label ID_LABEL is a 64-bit number. The random number RAND is exclusive-ORed with the identity label ID_LABEL to generate an enable code ENABLE (step S7), which is transmitted by the transceiver 21 (step S8). Once the enable signal is transmitted, the power supplied by rectification of the interrogation signal is spent and the RF tag 19 becomes inactive until another signal is received.

Meanwhile, the mobile telephone 1 waits to receive a reply to its interrogation signal (step S9). If the telephone 1 receives a signal within a predetermined time, for example 100 ms, the radio interface circuit 12 measures the power of the signal P (step S10). However, if no signal is received and the counter timeouts (step S11), the radio interface circuits 12 set the measured signal power P to zero (step S12).

Figure 5C:
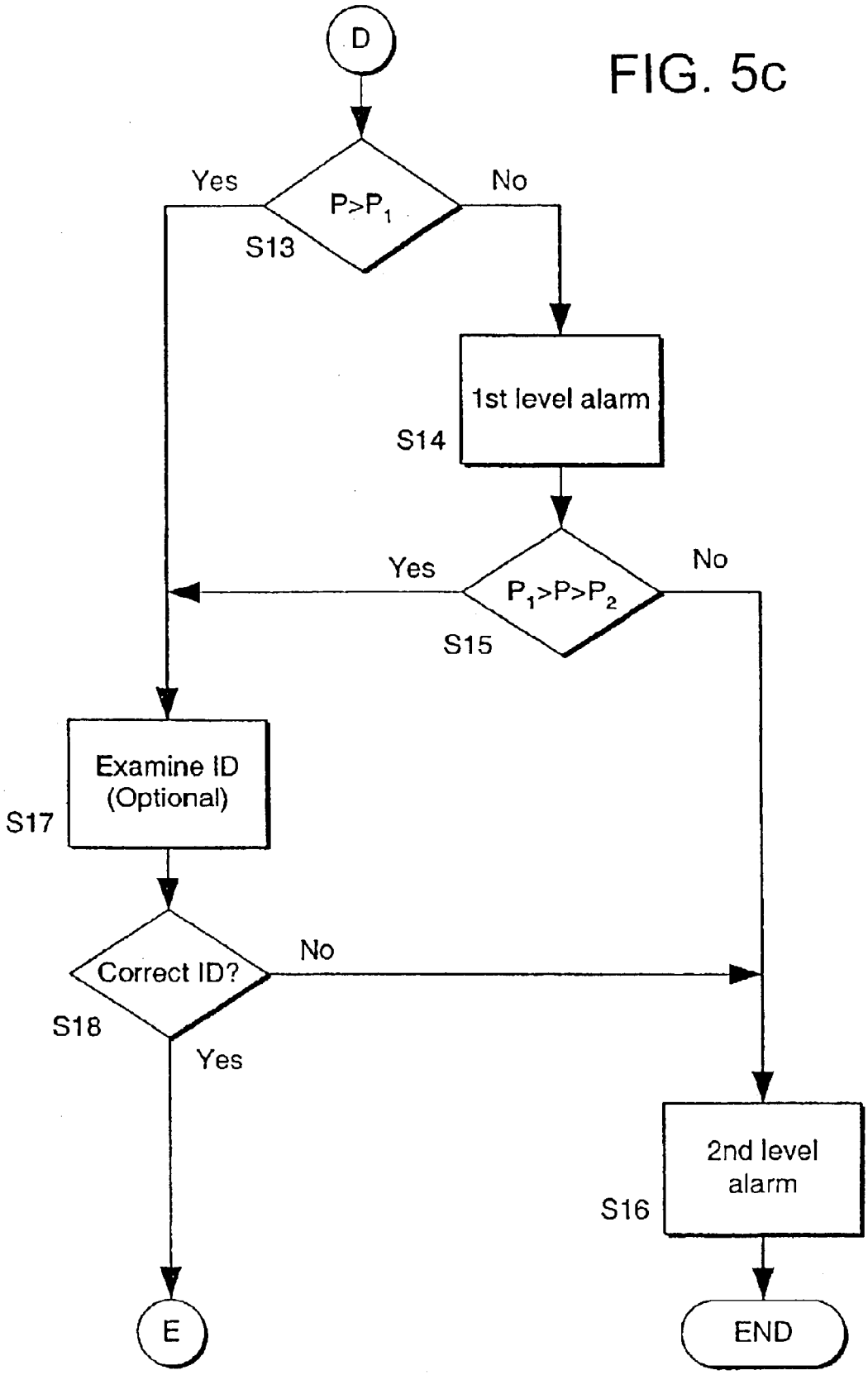

Referring to FIG. 5*c*, the mobile telephone 1 assesses the strength and quality of the enabling signal. The radio interface circuit 12 determines whether the power of the received signal P is above or below a first non-zero, power level $P_1$ (step S13). If the received signal power P is below the first power level $P_1$, then the controller 14 activates a first level alarm (step S14). In this example, the first level alarm is an audible alarm emitted by the ringer 11. It will be appreciated that other alarms may be used such as a flashing display, illuminated keys and vibration. The radio interface circuit 12 tests whether the power of the received signal P is above or below a second, smaller, non-zero power level $P_2$ (step S15). If the received signal power P is less than the second power level, the controller 14 activates a second level alarm (step S16). In this example, the second level alarm is also an audible alarm emitted by the ringer 11, but it is louder and higher in pitch than the first alarm. However, other types of alarm may be used. After the second alarm is alerted, the mobile telephone 1 disables itself. It can be re-enabled, for example, by entering a personal identification number (PIN). The second level alarm is explained in more detail later.

Thus, the first level alarm serves as a gentle reminder to the user 16 to keep the mobile telephone 1 by them, while the second level alarm alerts the user 16 to impending loss or theft of the telephone 1. Furthermore, the second level alarm may also trigger the mobile telephone 1 to activate security features.

If the received signal power P is above the first power level $P_1$ or the second power level $P_2$, then the controller 14 may optionally examine the enable code ENABLE (steps S17 & S18). This may be used to prevent other RF tags from innocently enabling the mobile telephone 1 or to frustrate attempts to steal the telephone 1 using another RF tag without the alarm sounding.

The controller 14 retrieves from memory 15 a copy of the RF tag's identity label ID_LABEL and exclusive-ORs the label with the randomly generated number RAND to generate a local version of the enable code LOCAL. The controller 14 compares the local enable code LOCAL with the received enable code ENABLE. If they match, the received enable code ENABLE is verified as being authentic and the mobile telephone 1 continues to operate. The process repeats itself by generating and transmitting a new random number RAND (step S1). The process may be repeated, for example every 10 seconds. If the local enable code LOCAL and the received enable code ENABLE do not match, the received enable code ENABLE is rejected as being a forgery and the mobile telephone 1 activates the second level alarm (step S16).

It will be appreciated that the random number RAND and the enable code ENABLE may be encrypted before transmission. It will also be appreciated that the mobile telephone 1 may be configured to check the result the comparison, for example by repeating the process with a new random number, to allow for innocent corruption of the code or collision of several enable codes transmitted by different RF tags. Alternatively, the mobile telephone 1 may be configured to allow receipt of several enable codes and search through them until the correct enable code is found.

Thus, while the mobile telephone 1 and the RF tag 19 are close enough together, the RF tag 19 will receive a strong enough signal to operate and process the interrogation signal and return an enabling signal to the mobile telephone 1 to allow the mobile telephone 1 to operate.

The first embodiment describes a badge, which transmits an enabling signal in response to a prompt from the mobile telephone 1. The second embodiment is a modification, which, amongst other things, allows the badge to send an enable unprompted.

Figure 6:
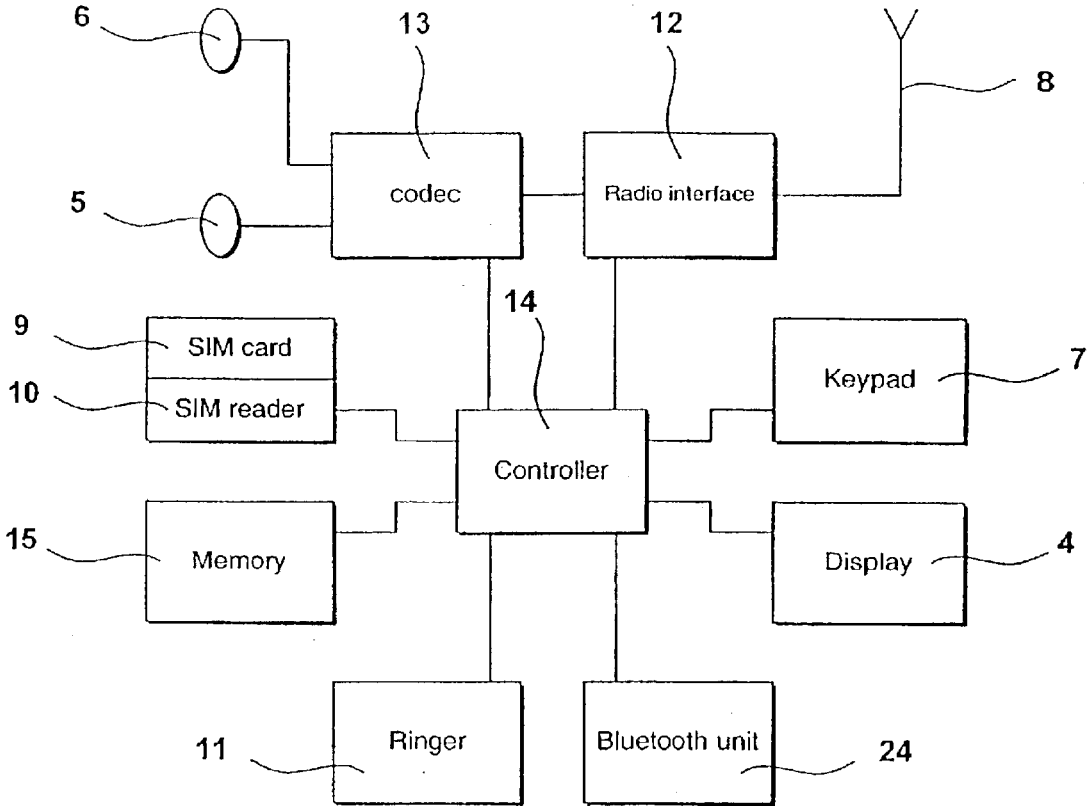
FIG. 6 is a schematic block diagram of the mobile telephone circuits according to a second embodiment of the present invention.

Referring to FIGS. 1 and 6, the mobile telephone 1 shown in FIGS. 1 and 2 is modified to include a first Bluetooth™ chip 24.

Figure 7:
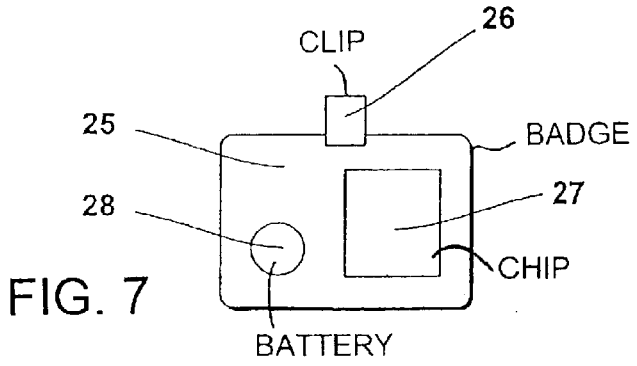
FIG. 7 is a schematic block diagram of an active badge according to the second embodiment of the present invention.

Referring to FIG. 7, the badge 17 shown in FIG. 3 is replaced by an active badge 25 with a clip 26 comprises a second Bluetooth™ chip 27 powered by a battery 28.

Figure 8:
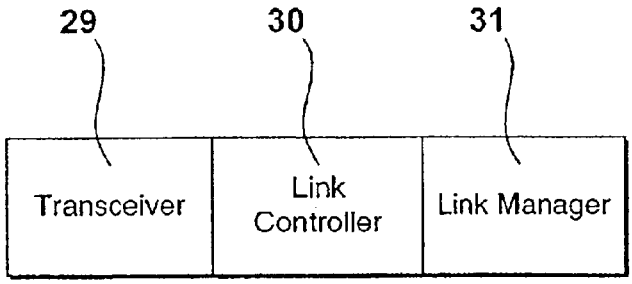
FIG. 8 is a schematic diagram of the functional parts of a Bluetooth chip.

Referring to FIG. 8, the first and second Bluetooth™ chips 24, 27 comprise a transceiver 29, a link controller 30 to control the physical establishment of the radio link and a link manager 31 to manage the execution of link protocols and to interface with an electronic device. In this example, the first Bluetooth chip 24 is interfaced with the mobile telephone controller 14.

The Bluetooth™ system allows electronic devices to communicate with each other using short-range radio links. The system is configured to connect between two and eight devices to form a "piconet". One device in the piconet serves as the master unit and its clock is used to synchronise communication throughout the piconet. Both voice and data may be communicated through the piconet. Overlapping piconets may be linked together to form a "scatternet". A Bluetooth™ specification (version 1.0 B) and a system overview may be found on the world-wide web at *www.bluetooth.com* or ordered from Bluetooth SIG, c/o Daniel Edlund, Facsimile No.: +46 70 615 9049.

Figure 9:
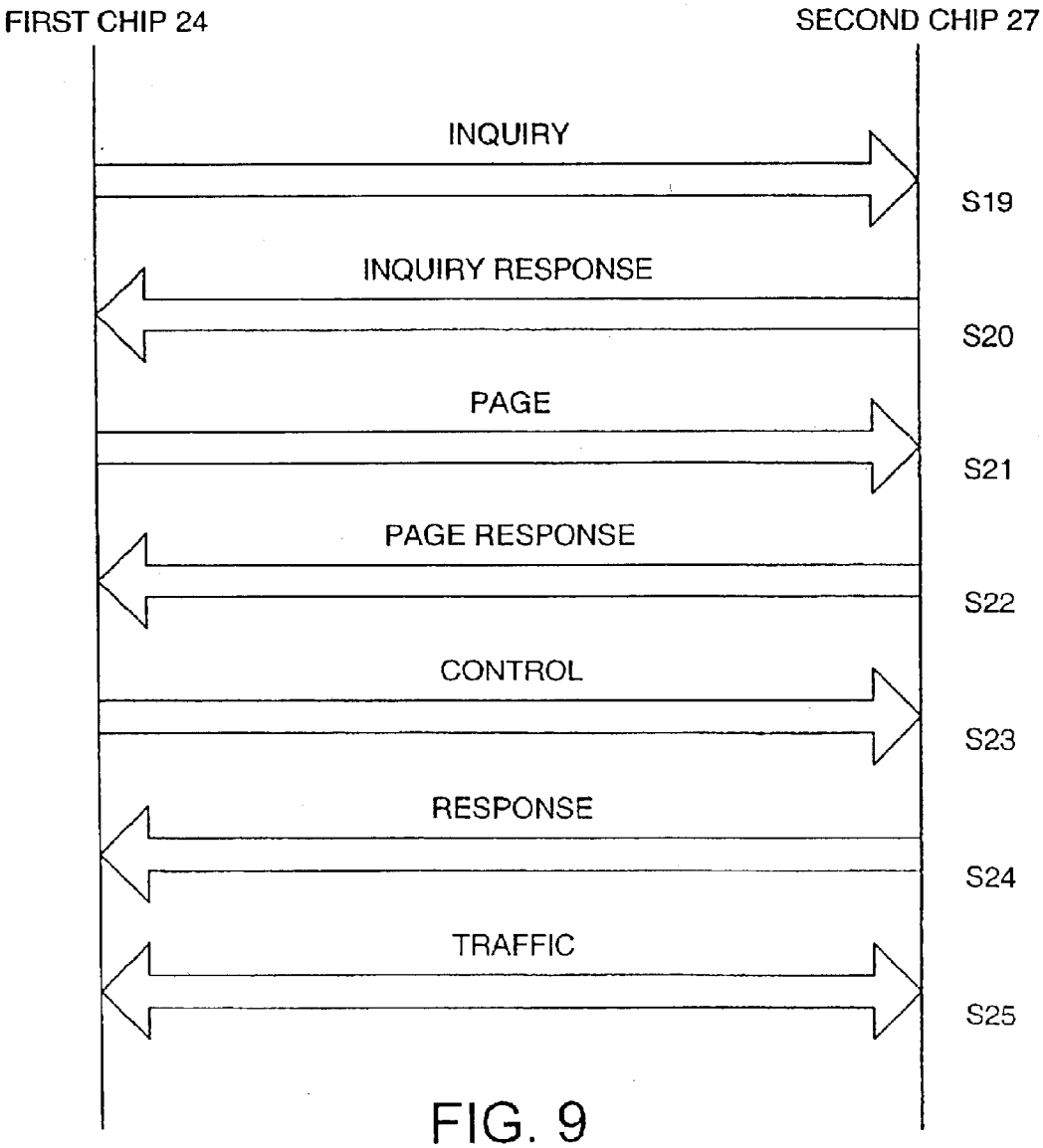
FIG. 9 is a sequence diagram showing the transfer of messages between two Bluetooth chips when establishing a wireless connection.

Referring to FIG. 9, a brief overview of how a connection is established between the first and second Bluetooth™ chips 24, 27 will now be described. Under normal conditions, the first chip 24 operates in a low-power consumption standby mode. The first chip 24 periodically "wakes-up" and enters an inquiry mode and repeatedly broadcasts inquiry message over a set of frequencies, inviting other devices to respond (step S19). The inquiry message may specify that only certain types of devices should respond and this is specified as an access code at the beginning of the message. Having broadcast an inquiry message, the first chip 24 listens for inquiry response messages on a different set of frequencies. The second chip 27 receives the inquiry message and replies with an inquiry response message, which contains its device address (step S20).

The first chip 24, now in possession of the second chip's device address, passes into page mode. A page message is transmitted using a hopping sequence determined by the device address (step S21). The second chip 27 receives the page message and replies by sending a page response message (step S22). The process by which the second chip 27 begins to synchronise to the first unit's clock now begins. The first chip 24 sends a special control packet that includes information relating to its clock data and the channel hopping sequence to be used and a second chip 27 confirms receipt with a response (steps S23 & S24). The first and second chips 24, 27 are now in a connected state and can begin exchanging packets of data (step S25) and are connected by means of a piconet. Higher level protocols manage the exchange of information between the mobile telephone 1 and the badge 25.

The second chip 27 in the connected state can operate in several modes. In an active mode, the second chip 27 listens to time and frequency slots for data packets from the first chip 24 and then sends data packets in other allocated slots. However, if no data is being transferred then the first chip 24 can arrange for the second chip 27 to be put in a power-saving mode. In such a mode, a hold mode, an internal timer is started and the second chip 27 becomes inactive for a fixed duration. Alternatively, the second chip 27 may be placed into sniff mode during which it polls the piconet at a reduced rate. Finally, the second chip 27 may be placed in park mode, wherein it surrenders its device address and does not participate in data traffic.

The radio transceivers operate at a 2.4 GHZ and have a broadcast range of up to 100 m. The amplitude of a transmitted signal diminishes with distance. Thus, as the separation of mobile telephone 1 and the active badge 25 increases, if the active badge 25 transmits a signal, the received signal at the mobile telephone 1 will become weaker and vice versa. The rate of signal fall-off with distance can be rapid and significant over a distance of a few meters.

If the user 16 inadvertently forgets the mobile telephone 1 and walks away from it or a thief steals the telephone 1 and attempts to make away with it, the separation of telephone 1 and the badge 25 increases. As a result, the strength of the signal transmitted by the active badge 25 and received by the mobile telephone 1 will fade. If the received signal strengths falls below a certain threshold or if the piconet breaks down, the mobile telephone 1 is configured to raise an alarm and, if necessary, disable itself.

Figure 10:
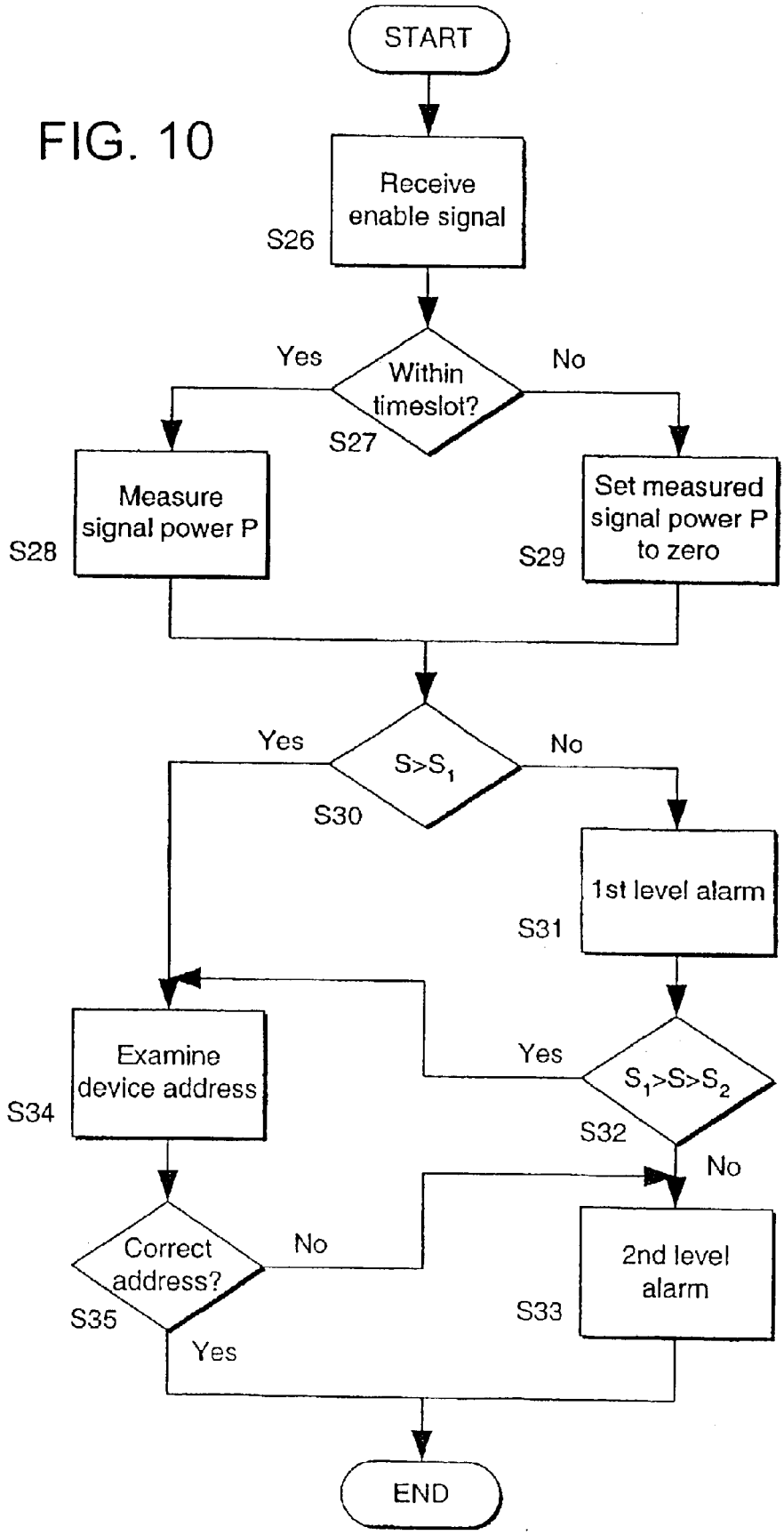
FIG. 10 is a process flow diagram of an interaction between the mobile telephone and the active badge according to the second embodiment of the present invention.

Referring to FIGS. 9 and 10, the second chip 27, located in the badge 25, periodically sends a message to the first chip 24 in an allocated time slot (step not shown). The message contains the second chip's address by which it may be identified. The first chip 24 checks to see if it receives a message in the time slot (steps S26 & S27). If the first chip 24 receives the message in the correct timeslot, it proceeds to measure the power of the signal S (step S28), otherwise it sets the measured power of the signal S to zero (step S29).

The first chip 24 determines whether the power S of the received signal is below the first power level $S_1$ (step S30). If the received signal power S is below the first power level $S_1$, then the first chip 24 alerts the mobile telephone controller 14, which activates a first level alarm, for example an audible alarm emitted by the ringer 11 (step S31). Other types of alarms as described hereinbefore may be used.

The first chip 24 tests whether the power of the received signal S is below a second, lesser, non-zero power level $S_2$ (step S32). If the received signal power S is less than the second power level $S_2$, the first chip 24 notifies the mobile telephone controller 14, which activates a second level alarm (step S33). In this example, the second level alarm is an audible alarm emitter by the ringer 11, louder and higher in pitch than the first alarm. Furthermore, the mobile telephone 1 is disabled and requires entering of a personal identification number (PIN) before it can be used again.

If the received signal power S is above the first power level $S_1$ or the second power level $S_2$, then the chip 24 checks the address of the message (steps S34 & S35). If the address is that of the second chip 27, the mobile telephone 1 continues operation, otherwise it alerts the mobile telephone controller 14 (step S33).

Thus, while the mobile telephone 1 and the active badge 25 are close enough together, the two Bluetooth chips 24, 27 form a piconet. If the piconet breaks down or the signals become too weak, then the mobile telephone 1 raises an alarm.

It will be appreciated that the Bluetooth chips may communicate in different ways to that described above. The enabling signal may be triggered in response a enquiry by the Bluetooth™ chip 24 in the mobile telephone 1. Furthermore, the mobile telephone 1 may process the enabling signal in a different manner. Alternatively, the piconet may be used to exchange a plurality of messages, the receipt of which is necessary to allow the mobile telephone to continue operation.

The mobile telephone 1 is provided with security features to prevent unauthorised use. For example, whenever the mobile telephone 1 is switched on, the user 16 is asked to enter a four-digit PIN on the keypad 8. If the correct PIN is entered, the mobile telephone 1 continues to operate. If an incorrect number is entered then the user is permitted another attempt. If the correct PIN number is not entered by the third attempt then use of the mobile telephone 1 barred. The mobile telephone 1 switches itself off.

Figure 11:
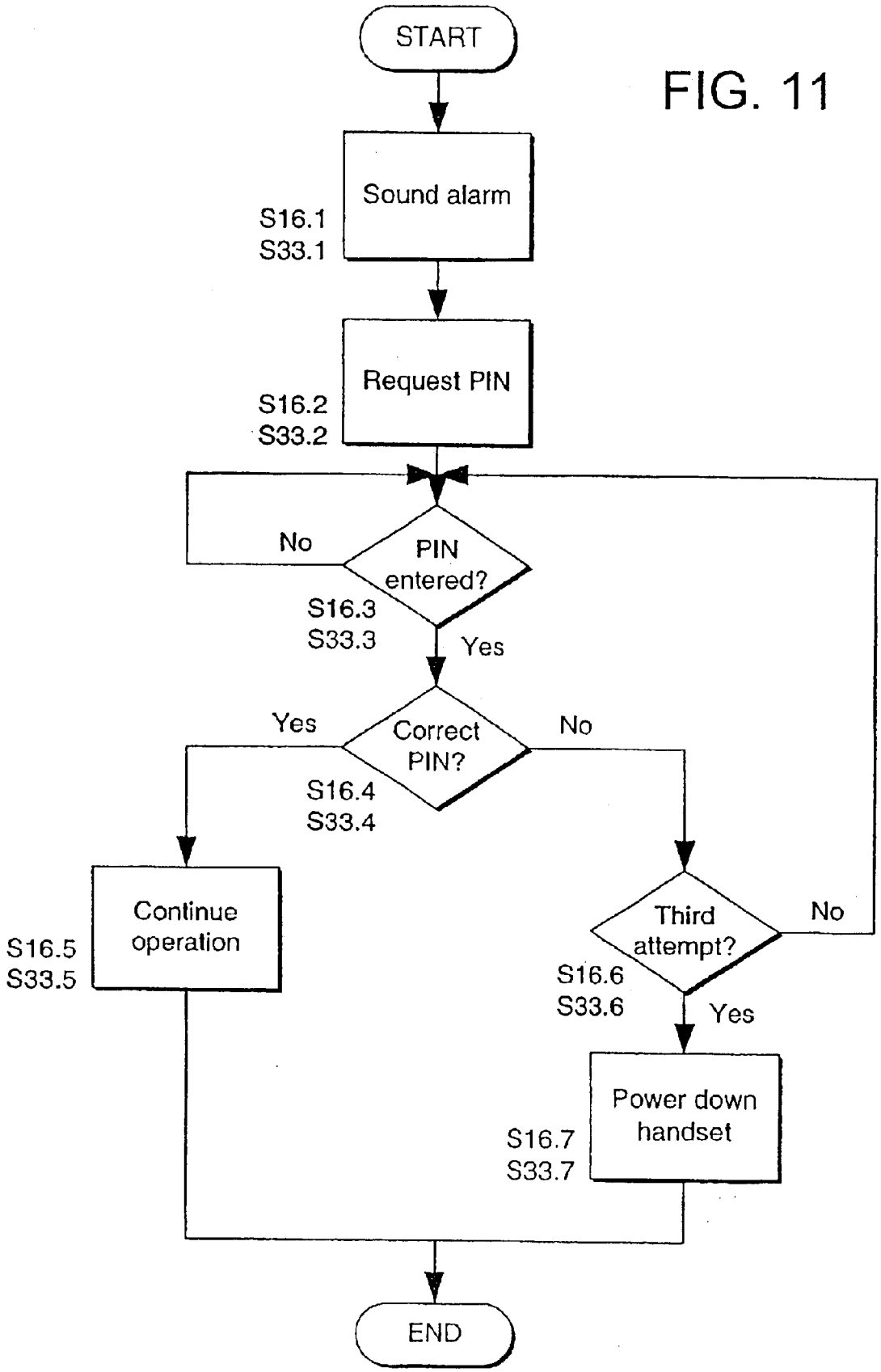
FIG. 11 is a process flow diagram of the operation of the mobile telephone when a high priority alarm is raised according to either the first or second embodiments.

Referring to FIGS. 5*c*, 10 and 11, if the second level alarm is raised (steps S16 or S33), then the mobile telephone 1 sounds a loud, high-pitched alarm on the ringer 11 (step S16.1, step S33.1). The LCD panel 5 displays a request to enter a PIN (step S16.2, step S33.2). The mobile telephone 1 waits until a 4-digit number is entered on the keypad 7 (step S16.3, step S33.3) and checks whether the number matches the PIN (step S16.4, step S33.4). In this example, the PIN is the same as the user-defined PIN entered on the keypad 7 whenever the mobile telephone 1 is switched on. Alternatively, it may be a different number and may have any number of digits. If the correct PIN is entered then the mobile telephone 1 continues to operate (step S16.5, step S33.5). If an incorrect number is entered, then the operator, who may be the user 16, is allowed another two attempts (step S16.6, step S33.6). If an incorrect number is entered three times, then the mobile telephone 1 is barred from further use and it switches itself off (step S16.7, step S33.7). This prevents unauthorised use.

The second embodiment comprises a single active badge 25 and a single mobile telephone 1. The third embodiment is a modification of the second embodiment in which the user 16 holds more than one Bluetooth unit, for example one in the form of an active badge 25 and one in an article of jewellery, such a watch.

Figure 12:
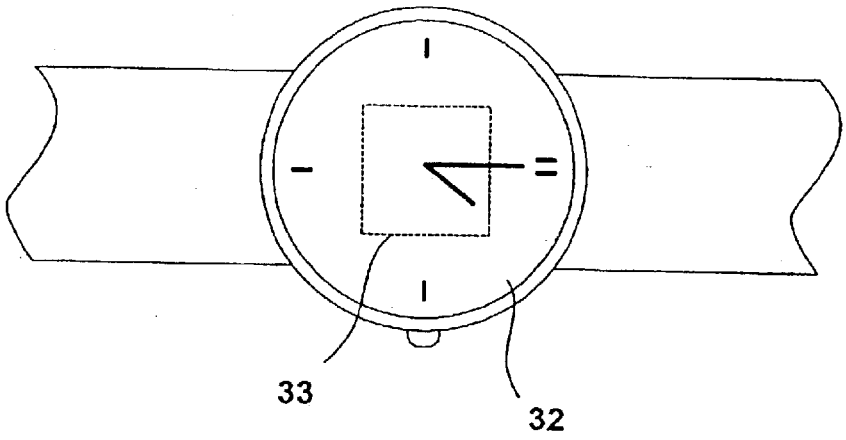
FIG. 12 shows a watch comprising a Bluetooth unit.

In FIG. 12, a watch 32 is shown comprising a third Bluetooth chip 33. When in close proximity, the first, second and third Bluetooth units 24, 27, 33 form a piconet. In this example, the first Bluetooth unit 24 in the mobile telephone 1 is the master unit.

Figure 13:
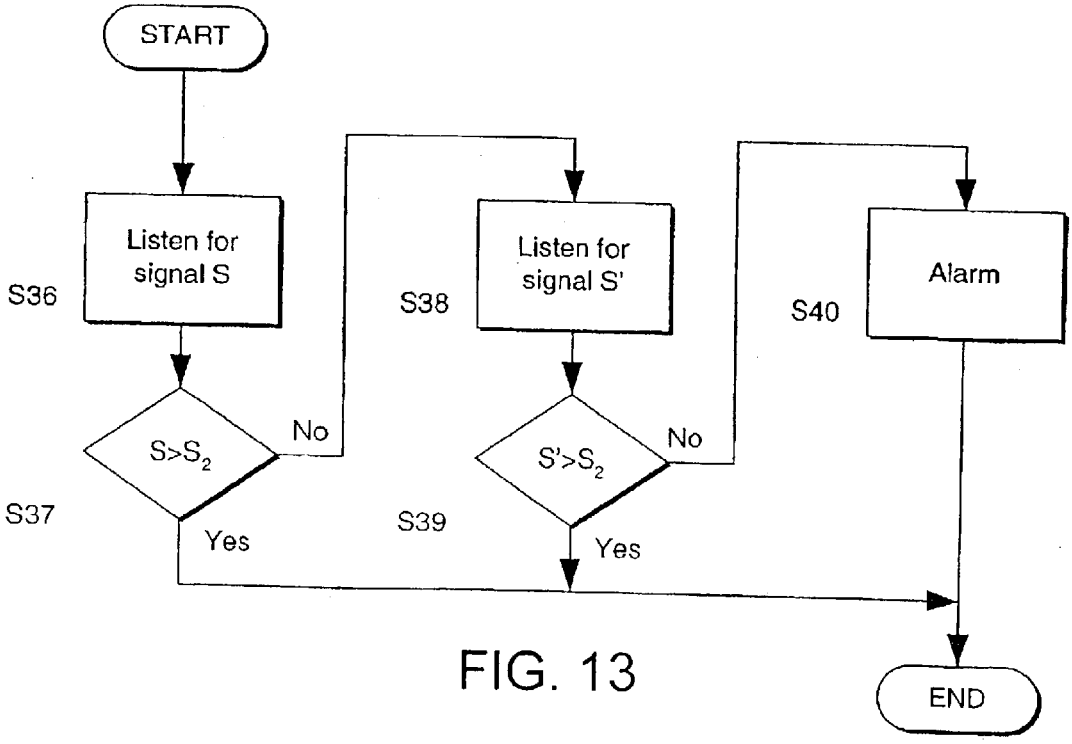
FIG. 13 is a process flow diagram of an interaction between the mobile telephone and a watch according to the third embodiment of the present invention.

Referring to FIG. 13, the first Bluetooth unit 24 checks whether it has received an enabling signal S from the second Bluetooth unit 27 in a similar manner described hereinbefore (steps S36 & S37). In this example, however, the first chip 24 checks whether the received signal power S is below the second power level $S_2$. If the received signal power S falls below the second power level $S_2$, then the first chip 24 checks whether it has received a further enabling signal S' from the third Bluetooth unit 33 (steps S38 & S39). If the power of the further signal S' falls below the second power level $S_2$, then the first chip 24 alerts the mobile telephone controller 14, which activates the second level alarm and disables the mobile telephone 1 as describe hereinbefore (step S40). Thus, the alarm is activated when both the badge 25 and the watch 32 are out of range of the piconet formed with the mobile telephone 1. It will be appreciated that the user 16 can hold more than two Bluetooth units, in a variety of articles, including clothing, jewellery and other personal items, and that they may be selectively activated or deactivated. The piconet allows up to eight Bluetooth units to participate, so allowing the user to hold up to seven Bluetooth units. Furthermore, the mobile telephone 1 may be programmed to trigger one or more alarms according to different received signal power conditions. For example, the process described with reference to FIG. 13 may include both first and second level alarms.

The fourth embodiment is a variation of the third embodiment in which the user 16 holds a Bluetooth unit, for example one in the form of an active badge 25, and more than one piece of equipment such as a mobile telephone 1 and a laptop computer each hold Bluetooth units respectively. Thus, if either the telephone 1 or the computer become separated from the badge 25 then they activate an alarm.

The first Bluetooth unit 24 checks whether it has received the enabling signal S from the second Bluetooth unit 27 according to the procedure described with reference to FIG. 10. In this example, a laptop computer (not shown) having a fourth Bluetooth chip (not shown) also checks whether it has received the enabling signal S and independently executes the same procedure. Thus, if either the telephone 1 or the computer become separated from the badge 25 then they emit an alarm. It will be appreciated that the Bluetooth units may co-operate such that if either the telephone or the computer wanders away and become separated from the badge 25, then both the wandering and the remaining pieces of equipment activate alarms. This may be coordinated by the master unit, which may be the second Bluetooth unit 27 located in the badge 25 or article of jewellery.

It will be appreciated that while the invention had been described in relation to mobile telephones, it can be used with any sort of portable electronic apparatus, for example, hand held computers.

It will be appreciated that many modifications may be made to the embodiments described above. For example, the RF tag or the Bluetooth chip may be incorporated into a piece of jewellery, such as a ring or medallion or into an item of personal property such as a handbag.

The apparatus may also be used to prevent unauthorised use of and theft from a cash register. The cash register is fitted with a receiver and a controller or a Bluetooth unit. A till operator keeps on or about them an RF tag or active badge. The cash register may only operate when the till operator is present at the cash register.

What is claimed is:

1. A communication unit including a device for preventing loss or theft of the unit, the device receiving and assessing an enabling signal comprising identity information from an external source, and controlling operation of the communication unit in dependence upon the assessment, the device measuring signal strength of the enabling signal and examining the identity information included in the enabling signal, triggering a first alarm if the enabling signal strength is below a first predetermined level and triggering a second alarm if the enabling signal strength is below a second predetermined level that is lower than the first predetermined level, with the alarms perceptibly indicating different alarm conditions, wherein the device determines whether the identity information correctly enables operation of the unit only if signal strength of the enabling signal is above the second predetermined level, and wherein the unit is not inoperable until the unit is enabled.

2. A communication unit according to claim 1 wherein:

the device comprises a radio frequency tag.

3. A communication unit according to claim 1 wherein:

the device is incorporated in a smart card.

4. A communication unit according to claim 1 wherein:

the first device is incorporated within a badge.

5. A communication unit according to claim 1 wherein:

the first device is incorporated in an item of jewelry.

6. A communication unit according to claim 1 wherein:

the first device is incorporated in an article of clothing.

7. A communication unit according to claim 1 wherein:

the first device is incorporated into an item of personal property.

8. A communication unit according to claim 7 wherein:

the communication unit is a mobile telephone.

9. A communication unit according to claim 7 wherein:

the communication unit is a computer.

10. A system for preventing loss of theft of communication unit, the system comprising:

a communication unit;

a first control device which transmits an enabling signal; and a second control device which receives and assesses the enabling signal and controls operation of the communication unit in dependence upon the assessment; and wherein, the second control device measures signal strength of the enabling signal and examines identity information included in the enabling signal, triggering a first alarm if the enabling signal strength is below a first predetermined level and triggering a second alarm if the enabling signal strength is below a second predetermined level that is lower than the first predetermined level, with the alarms perceptibly indicating different alarm conditions, and determining whether the identity information correctly enables operation of the communication unit only if signal strength of the enabling signal is above the second predetermined level, and wherein the communication unit is not inoperable until the communication unit is enabled.

11. A method of preventing loss or theft of a communication unit, the method comprising:

transmitting an enabling signal;

receiving and assessing the enabling signal; and controlling operation of the communication unit in dependence upon the assessment; and measuring signal strength of the enabling signal and examining identity information included in the enabling signal, triggering a first alarm if the enabling signal strength is below a first predetermined level and triggering a second alarm if the enabling signal strength is below a second predetermined level that is lower than the first predetermined level, with the alarms perceptibly indicating different alarm conditions, wherein a determination is made whether the identity information correctly enables operation of the communication unit only if signal strength of the enabling signal is above the second predetermined level, and wherein the communication unit is not inoperable until the communication unit is enabled.

12. A communication unit including a controller, the communication unit receiving and assessing an enabling signal from an external source and which controls operation thereof in dependence upon assessing the enabling signal to prevent loss or theft of the communication unit under control of the controller; and wherein signal strength of the enabling signal is measured and identity information included in the enabling signal is examined, triggering a first alarm if the enabling signal strength is below a first predetermined level and triggering a second alarm if the enabling signal strength is below a second predetermined level that is lower than the first predetermined level, with the alarms perceptibly indicating different alarm conditions, wherein the controller determines whether the identity information correctly enables operation of the communication unit only if signal strength of the enabling signal is above the second predetermined level, and wherein the communication unit is not inoperable until the communication unit is enabled.

13. A communication unit including a controller, the communication unit receiving and assessing an enabling signal from an external source, the controller controlling operation of the communication unit in dependence upon an assessment of the enabling signal to prevent loss or theft, the communication unit under control of the controller which measures signal strength of the enabling signal and examines identity information included in the enabling signal, triggers a first alarm if the enabling signal strength is below a first predetermined level and triggers a second alarm if the enabling signal strength is below a second predetermined level that is lower than the first predetermined level, with the alarms perceptibly indicating different alarm conditions, wherein the controller determines whether the identity information correctly enables operation of the communication unit only if signal strength of the enabling signal is above the second predetermined level, and wherein the communication unit is not inoperable until the communication unit is enabled.

* * * * *